United States Patent [19]

Vassiliou

[11] 4,226,646

[45] Oct. 7, 1980

[54] PROCESS OF COATING A FERROUS METAL SUBSTRATE WITH AN AQUEOUS FLUOROPOLYMER COATING

[75] Inventor: Eustathios Vassiliou, Newark, Del.

[73] Assignee: E. I. Du Pont de Nemours and Company, Wilmington, Del.

[21] Appl. No.: 24,096

[22] Filed: Mar. 26, 1979

[51] Int. Cl.[2] ..... C23F 7/00

[52] U.S. Cl. ..... 148/6.14 R; 428/422; 427/375

[58] Field of Search ..... 428/422; 427/375, 388 C; 148/6.14 R; 204/181 R

[56] References Cited

U.S. PATENT DOCUMENTS

| | | | |
|---|---|---|---|
| 2,776,918 | 1/1957 | Bersworth | 148/6.15 R |
| 3,506,555 | 4/1970 | Stadler et al. | 204/181 R |
| 3,556,968 | 1/1971 | DeVittorio | 204/181 R |
| 3,677,827 | 7/1972 | Weaver | 148/6.14 R |
| 3,788,961 | 1/1974 | Buxton | 204/181 R |
| 4,039,713 | 8/1977 | Vassiliou | 428/422 |
| 4,120,996 | 10/1978 | Castellucci | 427/318 |

OTHER PUBLICATIONS

Finishing Industries, vol. 2, #12, News Page 1, Dec. 1978.

*Primary Examiner*—Ralph S. Kendall

[57] ABSTRACT

Prior to applying aqueous coatings to ferrous metal substrates, triethanolamine is applied. This permits subsequent coating without flash rusting.

3 Claims, No Drawings

PROCESS OF COATING A FERROUS METAL SUBSTRATE WITH AN AQUEOUS FLUOROPOLYMER COATING

BACKGROUND

This invention concerns preparing ferrous metal substrates for coating, more particularly for coating with aqeuous dispersions containing fluorocarbons.

Triethanolamine has been used in small quantities, such as about 1%, to aid in dispersing pigments in fluorocarbon primer compositions. Larger amounts, such as 4%–4½% of triethanolamine have been used in fluorocarbon topcoat coating compositions containing fugitive coalescing agents which decompose after aiding in the coalescence of the fluorocarbon during curing of the coating at elevated temperatures. (Parts and percentages herein are by weight except where indicated otherwise.).

Several U.S. patents disclose fluorocarbon coating compositions which can be used in conjunction with the present invention, including U.S. Pat. Nos. 4,011,361—Vassiliou and Concannon (1977); 4,016,125—Vassiliou and Concannon (1977); 4,039,713—Vassiliou (1977); 4,049,863—Vassiliou (1977); 4,070,525—Vassiliou and Concannon (1978); 4,087,394—Concannon (1978); and 4,123,401—Berghmans and Vary (1978). These patents are incorporated herein by reference.

Such compositions are useful in coating cookware and other types of substrates.

SUMMARY OF THE INVENTION

The present invention provides a process of preparing a ferrous metal substrate to be coated with an aqueous fluoropolymer coating wherein the substrate is first coated with triethanolamine in a volatile liquid carrier.

Preferably, the triethanolamine is applied to the substrate as a 2%–15%, preferably 4%, by weight solution in a volatile liquid carrier such as isopropanol. The carrier volatilizes quickly, leaving the triethanolamine.

DETAILED DESCRIPTION

The present invention can be used to prepare ferrous metal substrates for coating with aqueous coating compositions. It prevents the deleterious formation of iron oxide or flash rusting of the substrate that would occur without the triethanolamine treatment.

As an example of the invention, a carbon steel substrate can be coated with a solution of isopropanol containing 4% by weight of the total of triethanolamine. Enough coating is used to completely wet the surface, thereby preferably giving at least about a monomolecular layer of triethanolamine on the surface.

While other compounds such as ascorbic acid or vitamin C may give some useful effect in minimizing flash rusting, triethanolamine appears to be superior.

After the triethanolamine has been applied, the isopropanol quickly evaporates at room temperature, such as about 23° C. Then the thus-treated substrate can be coated with, for instance, the aqueous coatings of any of the above-cited patents, including particularly those of the example of U.S. Pat. No. 4,039,713.

I claim:

1. A process of coating a ferrous metal substrate with an aqeuous fluoropolymer coating with minimum flash rusting wherein the substrate is first coated with triethanolamine in a volatile liquid carrier, then evaporating the carrier, then coating the substrate with an aqueous fluoropolymer coating.

2. The process of claim 1 wherein the liquid carrier is isopropanol.

3. The process of claim 2 wherein the triethanolamine is present in the isopropanol at a concentration of about 4% by weight of the total.

* * * * *